US005906483A

United States Patent [19]

Zhou

[11] Patent Number: 5,906,483

[45] Date of Patent: May 25, 1999

[54] ROTARY FILM CALCINER

[75] Inventor: Jun Pei Zhou, East Amherst, N.Y.

[73] Assignee: Harper International Corp., Lancaster, N.Y.

[21] Appl. No.: 09/071,396

[22] Filed: May 1, 1998

[51] Int. Cl.[6] ..... F27B 7/00

[52] U.S. Cl. ..... 432/112; 432/103; 432/113; 432/114; 159/11.1; 159/11.2; 159/16.2

[58] Field of Search ..... 432/103, 112, 432/113, 114, 118, 98, 102; 159/9.1, 9.2, 10, 11.1, 11.2, 11.3, 12, 16.2, 33, 49; 34/134, 135, 136, 137, 138

[56] References Cited

U.S. PATENT DOCUMENTS 1,944,452 1/1934 Ochs ..... 159/9.2
3,343,587 9/1967 Triplett et al. ..... 159/12

*Primary Examiner*—Teresa Walberg
*Assistant Examiner*—Jiping Lu
*Attorney, Agent, or Firm*—Arthur S. Cookfair; James J. Ralabate

[57] ABSTRACT

An apparatus for drying/calcining comprises a horizontally extending rotatable drum and a center tube, concentrically positioned within the rotatable drum to provide an annular combustion chamber between the outer wall of the center tube and the inner wall of the rotatable drum. One or more gas jet burners are positioned to inject gas fuel and combustion air into the annular combustion chamber in a tangential direction to create a vortex flow of combustion gases through the annular combustion chamber. The flue gas is discharged through the center tube. In operation, a material to be dried and/or calcined is applied to the external wall of the rotatable drum as it rotates toward a scraper or doctor blade where the dried or calcined product is removed by scraping.

11 Claims, 3 Drawing Sheets

ROTARY FILM CALCINER

BACKGROUND OF THE INVENTION

1. Field of the Invention

This invention relates to a gas-fired rotary industrial process furnace, adapted for the treatment by drying and/or calcining of materials and collection of the treated materials.

2. Prior Art

A variety of industrial process furnaces are known and have been designed with features that provide for the various considerations found in the drying and/or calcining of materials. Such considerations include, for example, the temperature required; whether the furnace should be of the direct-heat type requiring direct contact between the hot gases and the material being treated, or the indirect-heat type wherein heat is transferred by conduction through a wall to the material being treated; whether the operation should be continuous or batch; the particular materials to be treated, the economy of the construction and the operation of the furnace, etc.

U.S. Pat. No. 3,228,454 discloses a drum dryer of the indirect-heat type wherein the inside of a rotating drum is heated with steam while a slurry of the product to be heated is applied to the outside of the drum. As the drum rotates, the product is dried and then removed by means of a doctor blade. The apparatus is used for relatively low temperature operations such as the drying of cereals.

U.S. Pat. No. 5,299,512 discloses a burner designed for a rotary kiln and utilizing a particulate solid fuel, such as coal dust, with a liquid or gaseous fuel. The apparatus comprises concentrically positioned pipes to provide annular channels for the introduction of air, coal dust, and a liquid or gaseous fuel.

U.S. Pat. No. 5,123,361 discloses an annular vortex combustor having an outer vertical exhaust chamber. Fuel, such as powdered coal or coal water fuel, and air are injected tangentially near the bottom of the combustion chamber. Additional air is injected at selected points along the length of the combustion chamber.

U.S. Pat. No. 4,144,019 discloses a burner of the double vortex type wherein combustion gases and particulate travel in a spiral path through an outer cylindrical combustion chamber, then reverse direction to flow through an inner cylindrical combustion chamber and exit therefrom.

U.S. Pat. No. 3,799,252 discloses a roller drier wherein material to be dried is fed to the roller by means of a cylindrical feeding device and the dried material removed by means of a doctor blade.

SUMMARY OF THE INVENTION

The present invention provides a vortex combustion rotary film calciner well suited for drying and/or calcining materials by application of indirect heat, and characterized by a combination of important advantages, including high heat transfer coefficient, a wide operable temperature range, excellent uniformity of temperature, high evaporation effectiveness, and energy saving through high combustion and thermal efficiency. The rotary film calciner of the present invention comprises a horizontally extending rotatable drum having a closed end and a center tube concentrically positioned herein to provide an annular combustion chamber between the outer wall of the center tube and the inner wall of the rotatable drum and a combustion gas exhaust chamber within the center tube; at least one gas jet burner positioned to inject gas fuel and combustion air into the annular combustion chamber in a tangential direction to create a vortex flow of combustion gas along the length of the combustion chamber with a reversal of direction at the closed end of the combustion chamber to exit through the exhaust chamber. A feed mechanism is provided to apply a material to be dried or calcined to the external wall of the rotatable drum, as it rotates and a scraper or doctor blade to remove the dried or calcined product.

DETAILED DESCRIPTION OF THE INVENTION

Figure 1:
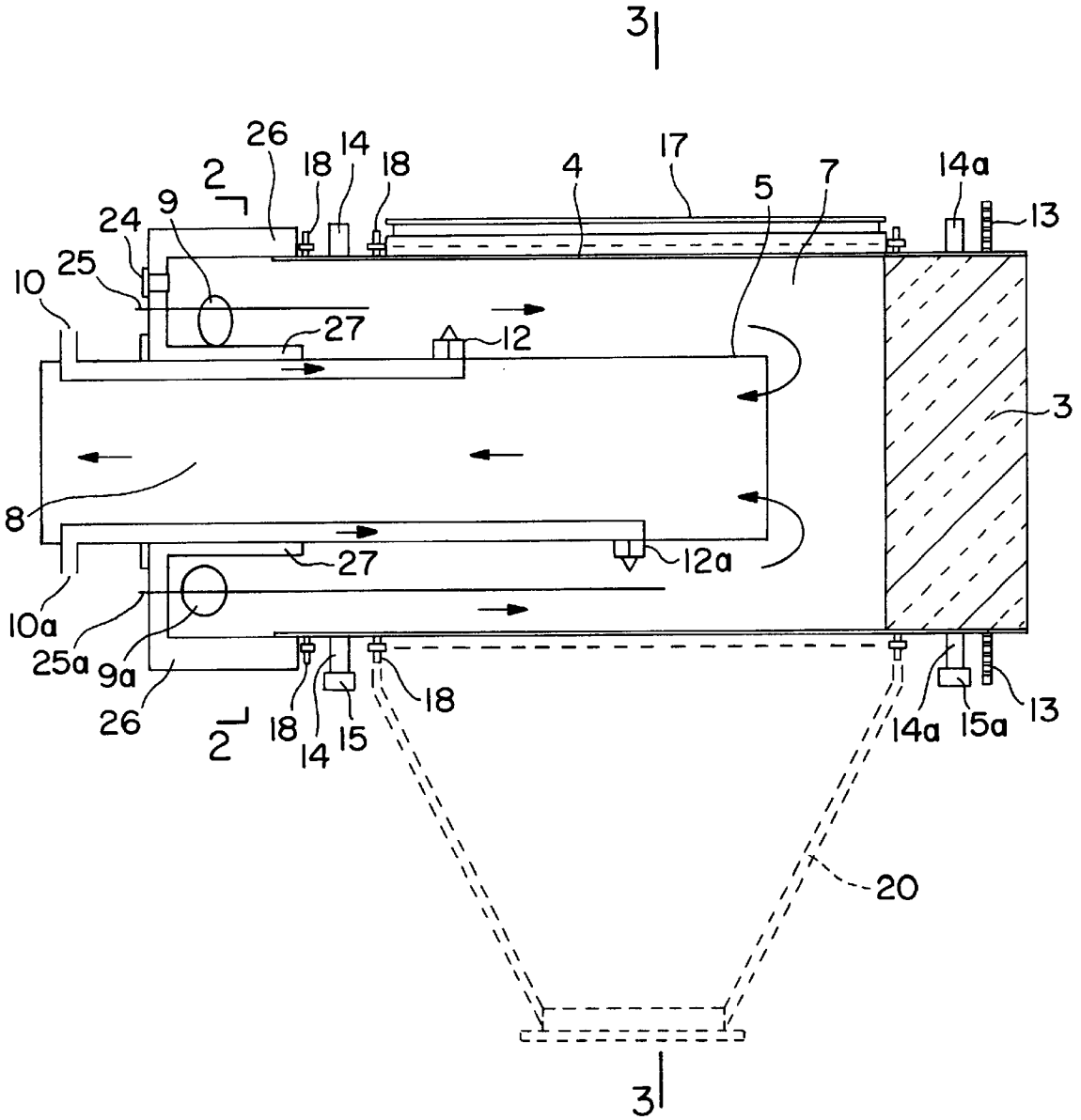
FIG. 1 is a sectional view of a rotary film drier/calciner of the present invention.
Figure 2:
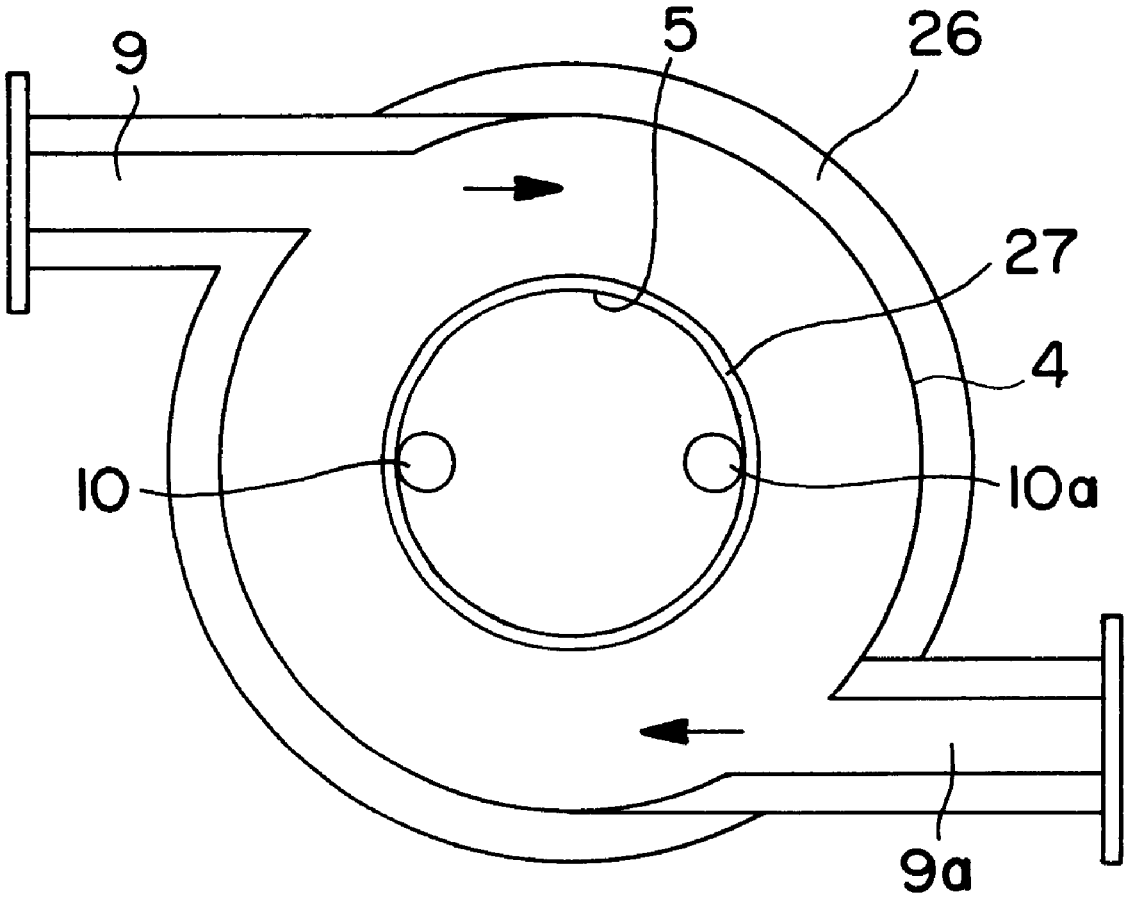
FIG. 2 is an end cross-sectional view taken along line 2—2 of FIG. 1.
Figure 3:
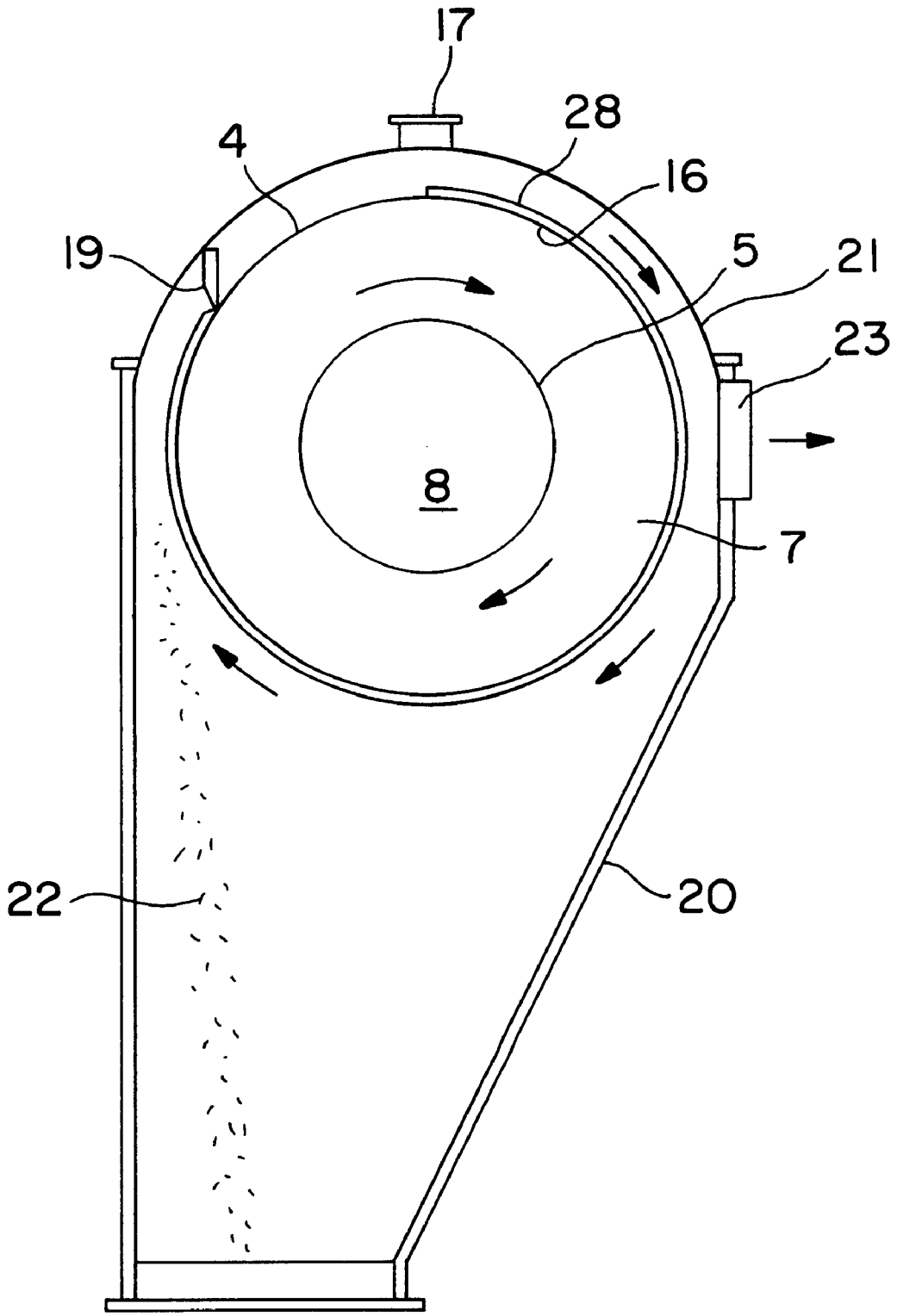
FIG. 3 is an end cross-sectional view taken along line 3—3 of FIG. 1.

The calciner of the present invention, as illustrated in FIGS. 1–3, includes a rotary drum 4 having a center tube 5 concentrically positioned within drum 4 to form an annular combustion chamber 7 for passage of combustion gas and an exhaust chamber 8, for the exiting of flue gas. Combustion gas and air are injected into the combustion chamber through burners 9 and 9*a*. Secondary air and/or gas for staged combustion may be supplied if desired through secondary gas pipes 10 and 10*a* and injected into the stream of combustion gas through secondary gas injection nozzles 12 and 12*a*. Burners 9 and 9*a* are positioned to inject a flow of combustion gas and air in a direction tangential to the combustion chamber to create a spiral flow. Similarly, the secondary gas nozzles 12 and 12*a* are directed in a manner that will contribute to the spiral flow. The flow of gases follows a generally spiral path from the burners 9 and 9*a* at the upstream end to the downstream end where, at insulated combustion chamber end 3 the gases reverse direction and exit through exhaust chamber 8 within center tube 5. The combustion gases in the annular combustion chamber 7 are contained by end cap 26 and seal 18 and flange 27 which provides support for center tube 5.

In operation, the drum 4 moves in response to movement of sprocket and chain 13, (driven by drive gear and motor means, not shown) with a rotary motion, supported by metal tires 14 and 14*a* on trunions 15 and 15*a*. The material to be treated is applied to the outside surface of the drum by applicator means 17 to form a film 28 on the surface of the drum 4. As the drum rotates, the film of material is indirectly heated by the burning gas through the wall 16. Typically, in a drying/calcining treatment, the material is applied, for example, by applicator means 17 through a series of nozzles (not shown) positioned lengthwise above the upper surface of the drum. The material to be treated is generally applied as a wet slurry or paste to form the film 28 on the drum surface and, as the heated drum rotates, the material is first dried and then calcined. The thermally treated material is removed by scraper 19. As the treated material is removed, the stream of removed material 22, typically in the form of flakes or powder, falls through hopper 20, to a collection container (not shown).

In a preferred embodiment, as depicted in FIG. 3, the rotary drum is enclosed to contain and control the volatiles as well as any dust or particulate matter from the drying/calcining treatment. Thus, a shroud or cover 21 is attached to the upper portion of hopper 20 to contain steam, dust, or volatiles from the drying/calcining and/or scraping operations. Such emissions may be discharged in a controlled manner through off-gas discharge port 23.

The enclosure of the drum 4 by cover 21 and hopper 20 during the drying/calcining operation provides an additional advantage. Selected gases may be injected within the enclosure to provide an atmosphere compatible with the drying/calcining of specific materials to avoid unwanted chemical reactions.

Various fuels may be employed including, for example, dry finely pulverized coal, coal water fuel, oil, or preferably gas, such as propane or natural gas. The preferred fuel is natural gas. The fuel and air are premixed and ignited and tangentially injected into the combustion chamber. The hot combustion gases, typically at a temperature of about 1000° C., then travel in a spiral path through combustion chamber 7, reversing direction at insulated combustion chamber end 3, to exit through exhaust chamber 8 within center tube 5, providing a uniform distribution of heat along wall 16. The flame condition inside the combustion chamber may be viewed through view port 24. The temperature in the combustion chamber may be monitored by means of thermocouples 25 and 25*a* and controlled by appropriate adjustments of gas and air being injected.

Although the invention has been described with reference to certain preferred embodiments, it will be appreciated by those skilled in the art that modifications and variations may be made without departing from the spirit and scope of the invention as defined by the appending claims.

What is claimed is:

1. A rotary film calciner for treating materials by application of indirect heat comprising:

a horizontally extending rotatable drum having an upstream end and a downstream end;

a center tube concentrically positioned within the rotatable drum forming an annular combustion chamber between an outer wall of the center tube and an inner wall of the rotatable drum and forming a combustion gas exhaust chamber within the center tube;

said annular combustion chamber and said combustion gas exhaust chamber each having an upstream end and a down stream end;

said center tube being open at each end to allow passage of combustion exhaust gases therethrough and having the upstream end spaced apart from the downstream end of said annular combustion chamber;

primary burner means for injecting combustion gases into the annular combustion chamber and directed to cause the combustion gases to travel from the upstream end thereof in a spiral path through the combustion chamber and exit through the gas exhaust chamber;

means for rotating said horizontally extending rotatable drum;

applicator means for applying a material to be treated to outer wall of the rotatable drum to form a film thereon;

product removal means for removing treated material from the outer wall of the rotatable drum.

2. A rotary film calciner according to claim 1 wherein the center tube is stationary.

3. A rotary film calciner according to claim 1 wherein center tube is rotatable.

4. A rotary calciner according to claim 1 where in said applicator means for applying a material to be treated to the outer wall of the rotatable drum comprises a series of nozzles positioned above said rotatable drum and extending in a line parallel to horizontal longitudinal axis thereof.

5. A rotary film calciner according to claim 2 wherein said primary burner means comprises two burners tangentially positioned approximately 180 degrees apart within said annular combustion chamber near the upstream end thereof.

6. A rotary film calciner according to claim 5 wherein said combustion gases are formed from natural gas and air.

7. A rotary film calciner according to claim 6, further including secondary gas inlet means for the injection of gases within said annular combustion chamber at a location upstream of said primary burner means.

8. A rotary film calciner according to claim 7 wherein said secondary gas inlet means comprises two gas inlets positioned approximately 180 degrees apart and at different upstream distances from said primary burner means.

9. A rotary film calciner according to claim 5 wherein said product removal means comprises a scraper blade positioned to remove treated product from the outer wall of the rotary drum.

10. A rotary film calciner according to claim 9 wherein said scraper blade is adjustable to compensate for changes in diameter of said rotary drum due to expansion from heat.

11. A rotary film calciner according to claim 9 further including an outer cover and hopper to contain gaseous products and to direct the flow of treated material removed by said product removal means.

* * * * *